United States Patent [19]

Sloot

[11] Patent Number: 5,020,931

[45] Date of Patent: Jun. 4, 1991

[54] SHAPED INDEX CARD

[75] Inventor: Alexander Sloot, Stamford, Conn.

[73] Assignee: Printmark Industries, Inc., Stamford, Conn.

[21] Appl. No.: 511,721

[22] Filed: Apr. 20, 1990

[51] Int. Cl.[5] ..... B42F 13/00

[52] U.S. Cl. ..... 402/79; 283/36; 40/360

[58] Field of Search ..... 402/79; 40/124.1, 360; 281/42; 283/36, 39, 41; D19/1, 75, 76, 86

[56] References Cited

U.S. PATENT DOCUMENTS

| | | | |
|---|---|---|---|
| 258,897 | 4/1981 | Glaubinger | D19/1 |
| 1,741,066 | 12/1929 | Morgan | 402/79 |
| 3,348,325 | 10/1967 | Snelgrove | 283/36 |
| 4,849,056 | 7/1989 | Ristuccia, Sr. | 402/79 |

OTHER PUBLICATIONS

"Shaped Ruler" by Sales Guides, Inc. Fall, 1990.
"Shaped Index Card" by Todd Allan Printing—1983.

*Primary Examiner*—Frank T. Yost
*Assistant Examiner*—Hwei-Siu Payer
*Attorney, Agent, or Firm*—St. Onge Steward Johnston & Reens

[57] ABSTRACT

A shaped index card has edges shaped to conform with and visually enchances an image on the index card. The index card may have an upper segment that extends visibly above the upper edges of conventional index cards. The image is located at least in part on the upper segment and the upper segment has a peripheral upper edge which is shaped to conform with the image. The shaped index card may also have a side edge shaped to conform with the image. The image identifies the goods or services of a supplier, and may include a logo, or an object associated with the supplier's business.

3 Claims, 3 Drawing Sheets

SHAPED INDEX CARD

FIELD OF THE INVENTION

The present invention relates to index cards generally and more specifically to index cards adapted to fit onto a dual rail card storage system.

BACKGROUND OF THE INVENTION

Conventional index card systems of the type manufactured and sold under the trademark Rolodex have parallel rails to which the lower edges of information containing cards are attached. In these conventional index card systems the cards have uniform straight upper and side edges. The cards are separated by alphabetic dividers.

It would be desirable for a a supplier of goods or services to be able to provide an index card to its customers that will stand out from surrounding cards in a conventional index card system, so that customers would have necessary information to contact the supplier. Such a card would desirably identify the supplier and would minimize searching through the index card.

SUMMARY OF THE INVENTION

It is an object of the present invention to provide an index card that is easily located in a conventional index card system. It is an object of the invention to provide an index card that is distinguished from conventional index cards. It is an object of the invention to provide an index card that is usable in a conventional index card system.

A shaped index card in accordance with one technique of the invention comprises a conventional index card but which is provided with shaped side and/or upper edges that complement and visually enhance an image located on the card. The shaped edges may lie within the normal periphery of a conventional index card with which the shaped index card is intended to fit. The shaped edges preferably conform with the outline of the image on the card.

In another specially shaped index card of the invention, the card has an upper segment that extends visibly above the upper edges of conventional index cards when the shaped index card is mounted in a conventional index card system. The image is located at least in part on the upper segment. The upper segment has a peripheral upper edge which is shaped to complement and visually enhance the image. In the preferred embodiment, the peripheral upper edge is shaped to conform with the image's upper outline.

The image preferably identifies goods or services from a supplier, and the image and shaped peripheral upper edge cooperate to provide an enhanced visual representation of such goods or services.

Means for mounting the index card to the dual retainer rails of the index card system are provided on the bottom edge of the index card, and preferably comprise conventional slots sized to receive the retainer rails to retain the index card in the index card system.

Other objects, aspects and features of the present invention in addition to those mentioned above will be pointed out in detail or will be understood from the following detailed description provided in conjunction with the accompanying drawings.

DETAILED DESCRIPTION OF THE DRAWINGS

DESCRIPTION OF THE PREFERRED EMBODIMENT

Figure 1:
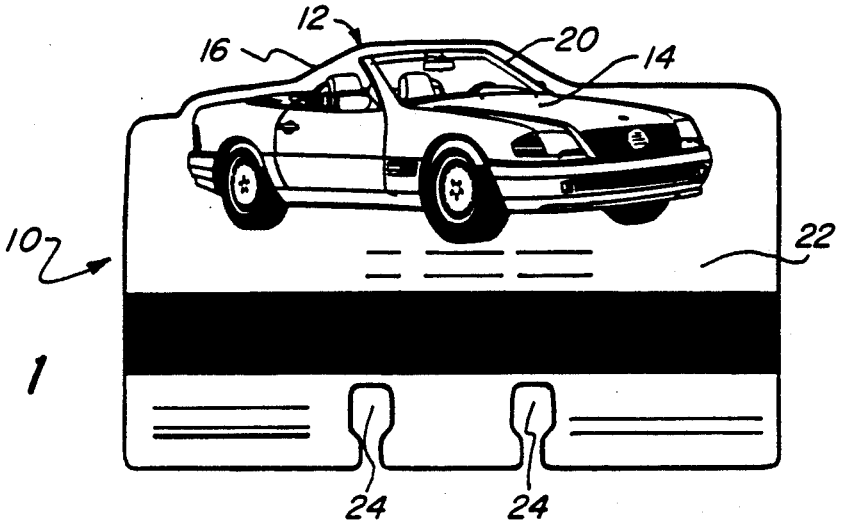
FIG. 1 is a front elevation view of a first embodiment of an index card in accordance with the invention.

Referring now to FIG. 1, a shaped index card in accordance with the invention is shown generally as 10. Shaped index card 10 has an upper segment 12 that extends visibly above the upper edges of conventional index cards when the shaped index card 10 is mounted in a conventional index card system.

An image 14 that is located on the card extends into the upper segment 12. The upper segment 12 has a peripheral upper edge 16 which is shaped to cooperate with and visually enhance the image 14. In the preferred embodiment, the image has an upper outline 20, and the peripheral upper edge 16 of the index card upper segment 12 is shaped to conform with the image's upper outline 20. Thus, in the shaped index card 10, the upper outline 20 of image 14 represents a perspective view of the front window frame of a convertible top automobile, and the peripheral upper edge 16 is shaped to conform with the outline of the automobile trunk and window frame when the convertible top is down to thus complement and cooperate with the upper part of the image 14 and to create a visually emphasized impression of image 14 on the index card 10.

The image 14 thus identifies the goods or services of a vendor, and the shaped peripheral upper edge 16 of the index card upper segment 12 cooperates with the image 14 to provide an enhanced visual representation of the goods. In FIG. 1, the convertible shown as image 14 and the cooperating peripheral upper edge 16 emphasize the association with an automobile dealership. Although it is preferable to have the image 14 extend above a conventional card, it is also possible to have a card with a shaped upper edge 16 that lies within the normal perimeter of a conventional index card.

Information relating to the business may be located on the informational area 22 of the shaped index card 10, as is commonly done.

Means for mounting an index card to the retainer rails of an index card system are provided on the bottom edge of the index card, and preferably comprise slots 24 sized to receive the retainer rails to retain the index card in the index card system.

Figure 2:
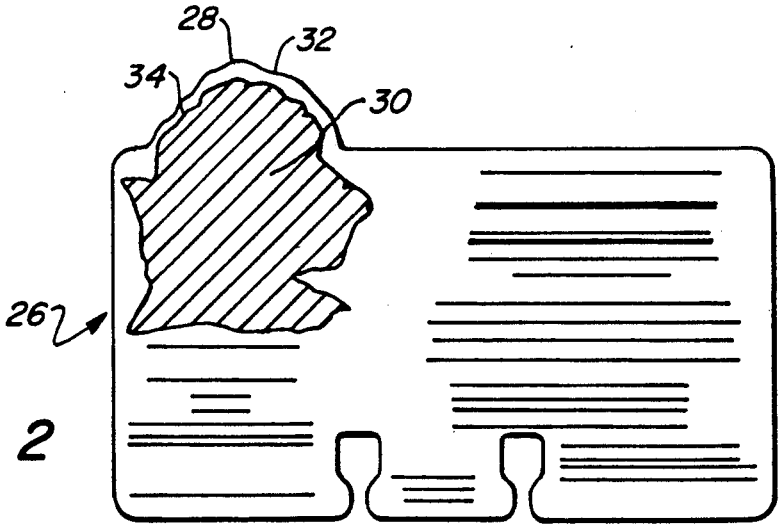
FIG. 2 is a front elevation view of a second embodiment of an index card in accordance with the invention.

Referring now to FIG. 2, a shaped index card 26 also has an upper segment 28 that contains part of an image 30 which is the head of a character - logo used in conjunction with a public service message elsewhere on the card. As can be seen, the peripheral upper edge 32 of card 26 is shaped to cooperate with and visually enhance the outline 34 of the character's head.

Figure 3:
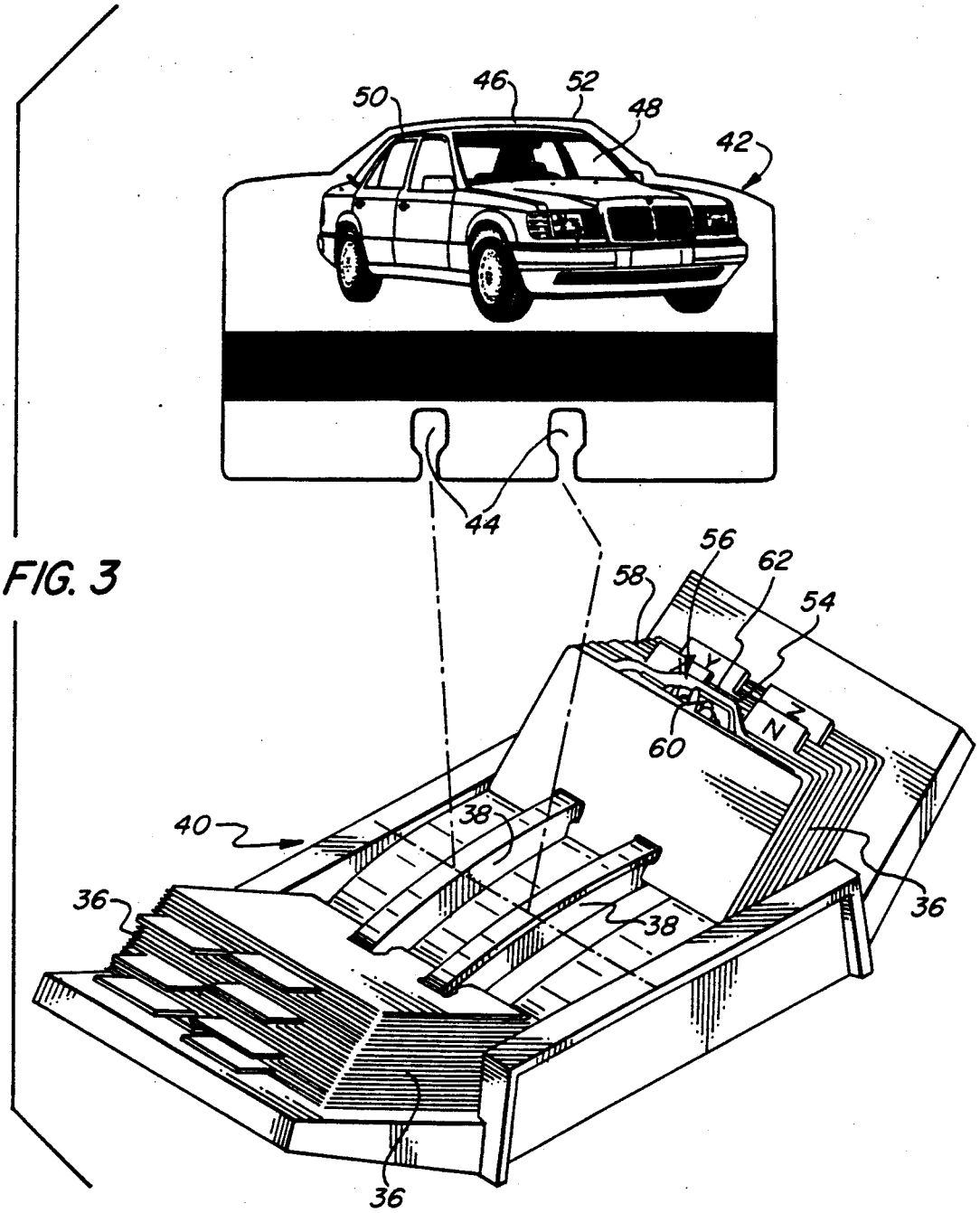
FIG. 3 is a perspective view of a conventional index card system with a third embodiment of an index card in accordance with the invention to be installed therein.

Referring now to FIG. 3, a plurality of conventional index cards 36 are shown installed in on the rails 38 of a card index system 40. In FIG. 3, a shaped index card 42 is shown ready to be installed in a conventional index card system 40. When installed, the slots 44 of card 42 fit onto rails 38 of the card system 40. Similarly, in FIG. 1, the slots 24 would mount onto the dual rails of a conventional card index system. Shaped index card 42 has an upper segment 46 that contains as an image 48 a perspective view of a sedan automobile. The image 48, and particularly its upper outline 50 is enhanced by the upper edge 52 of upper segment 46 that follows and complements the sedan roofline so as to produce an enhanced sedan image.

As also can be seen in FIG. 3, the upper segment 54 of a shaped index card 56 will extend above the plane of the upper edges 58 of the conventional cards 36 and the image 60 is visible thereon. The shaped peripheral edge 62 complements the image 60 and makes card 56 stand out from the surrounding cards 36 in the index card system 40, so that card 56 is easily located in the index card system by the image 60 contained thereon.

Figure 4:
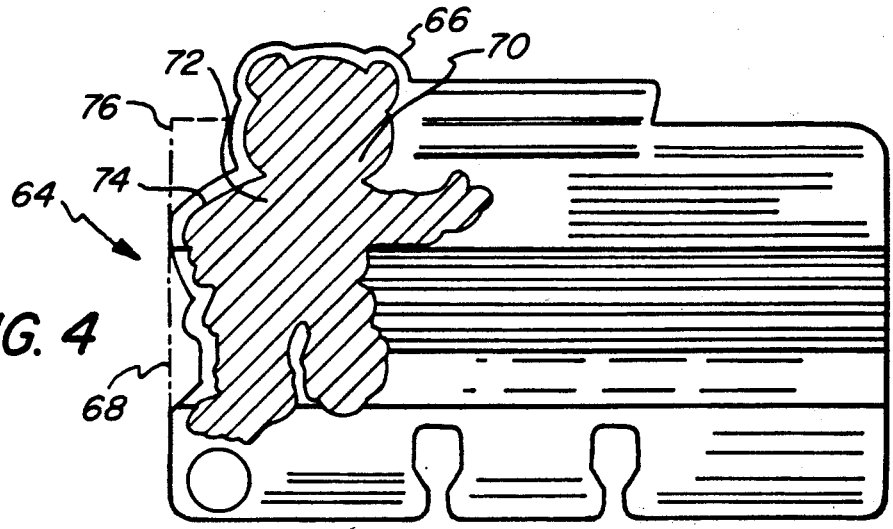
FIG. 4 is a front elevation view of a fourth embodiment of an index card in accordance with the invention.

Referring now to FIG. 4, a shaped index card 64 has both a shaped upper edge 66 and a shaped side edge 68. The shaped edges 66 and 68 conform with and enhance the visual representation of image 70 contained in segment 72 of shaped index card 64. In FIG. 4, image 70 comprises a character-logo representing customer service. The edges 66 and 68 closely conform with the outline 74 of image 70 to enhance and complements the character-logo outline 74. It is to be appreciated that the shaped side edge of an index card in accordance with the invention may be located on either or both sides of the card. The shaped side edge 68 of card 64 may encompass a side segment that extends laterally beyond the normal perimeter 76 of a conventional index card so that the image 70 is more readily located in an index card system, or the side edge 68 may be contained within the normal perimeter 76 of a conventional index card.

Having described several embodiments in accordance with the invention, its advantages may be appreciated. Other embodiments and variations of the invention may be made without departing from the scope of the following claims.

I claim:

1. A shaped index card for an index card system having retainer rails for holding the lower edges of a plurality of like sized conventional index cards whose upper edges are straight and which align when mounted on the retainer rails, comprising:

an index card having an upper segment that extends visibly above the upper edges of conventional index cards when said index card is mounted in an index card system;

a pictorial image which identifies goods or services of a supplier, said image having an upper outline located on said upper segment, said upper segment having a peripheral upper edge which is shaped to cooperate with said image upper outline to visually enhance said image, and said image further having a side outline, said shaped index card having a side edge shaped to conform with said image side outline and cooperate with and visually enhance said image, said side edge surrounding a side segment of said index card that laterally extends visibly beyond the side edges of conventional index cards when said shaped index card is mounted in an index card system and wherein said image is located at least partially on said side segment; and means for mounting said index card to the retainer rails of an index card system.

2. A shaped index card for an index card system having retainer rails for holding the lower edges of a plurality of like sized conventional index cards whose side edges are straight and which align when mounted on the retainer rails, comprising:

an index card;

a pictorial image which identifies goods or services of a supplier, said image having a side outline, said index card having a side edge which is shaped to conform with said image side outline and cooperate with and visually enhance said image; and said side edge surrounding a side segment of said index card that laterally extends visibly beyond the side edges of conventional index cards when said shaped index card is mounted in an index card system and wherein said image is located at least partially on said side segment; and means for mounting said index card to the retainer rails of an index card system.

3. A shaped index card for an index card system having retainer rails for holding the lower edges of a plurality of like sized conventional index cards whose side edges are straight and which align when mounted on the retainer rails, comprising:

an index card;

a pictorial image which identifies goods or services of a supplier, said image having a side outline, said index card having a side edge which is shaped to conform with said image side outline and cooperate with and visually enhance said image; and wherein said side edge is contained within the perimeter side edges of conventional index cards when said shaped index card is mounted in an index card system; and means for mounting said index card to the retainer rails of an index card system.

* * * * *